US005121623A

United States Patent [19]

Brzezniak

[11] Patent Number: 5,121,623

[45] Date of Patent: Jun. 16, 1992

[54] METHOD FOR CHANGING TRANSFER FINGERS IN A TRANSFER PRESS

[75] Inventor: Edward J. Brzezniak, Orland Park, Ill.

[73] Assignee: Verson, A Division of Allied Products Corporation, Chicago, Ill.

[21] Appl. No.: 694,371

[22] Filed: May 1, 1991

Related U.S. Application Data

[62] Division of Ser. No. 483,560, Feb. 21, 1990, Pat. No. 5,054,306.

[51] Int. Cl.[5] ..... B21D 43/10

[52] U.S. Cl. ..... 72/405; 72/362

[58] Field of Search ..... 72/405, 421, 422, 362; 198/621

[56] References Cited

U.S. PATENT DOCUMENTS

| | | | |
|---|---|---|---|
| 4,680,954 | 7/1987 | Mueller | 72/405 |
| 4,697,449 | 10/1987 | Harsch | 72/405 |
| 4,924,692 | 5/1990 | Rieger | 72/405 |

FOREIGN PATENT DOCUMENTS

| | | | |
|---|---|---|---|
| 3336082 | 4/1984 | Fed. Rep. of Germany | 72/405 |
| 3409035 | 9/1984 | Fed. Rep. of Germany | 72/405 |
| 3537269 | 4/1987 | Fed. Rep. of Germany | 72/405 |
| 3726294 | 8/1988 | Fed. Rep. of Germany | 72/405 |
| 162539 | 8/1985 | Japan | 72/405 |

*Primary Examiner*—Daniel C. Crane
*Attorney, Agent, or Firm*—Baker & Botts

[57] ABSTRACT

Shifting apparatus for use in a transfer press having moving die bolsters. The shifting apparatus includes transfer rail sets that are located on the bolster and on the fixed bed that are interconnected during the normal transfer of the work pieces between dies. Transfer fingers are carried by both transfer rail sets that serve to engage the work pieces and move the work pieces through the positions of the transfer press. The transfer finger shift apparatus extends between the two rail sets and includes a shaft carrying a shift base member which has transfer fingers connected thereto. An elevating device is provided on the fixed bed to raise the transfer fingers sufficiently to pass over the top of the transfer fingers located on the bolster. When it is desired to move the transfer fingers from the fixed bed to the bolster, the transfer rails are moved in the direction of the bolster moving the transfer fingers along the shaft and onto the bolster. A lock is provided which attaches the transfer fingers to the bolster and the rails are moved toward the fixed bed. The rails are separated and the bolster is moved to a remote location away from the press for replacement of the dies and related transfer fingers.

2 Claims, 9 Drawing Sheets

METHOD FOR CHANGING TRANSFER FINGERS IN A TRANSFER PRESS

RELATED APPLICATIONS

This application is a divisional application of U.S. patent application Ser. No. 07/483,560, filed Feb. 21, 1990, now U.S. Pat. No. 5,054,306, issued Oct. 8, 1991 and entitled "TRANSFER FINGER SHIFT APPARATUS FOR TRANSFER PRESSES".

TECHNICAL FIELD OF THE INVENTION

This invention relates generally to transfer presses. More particularly, but not by way of limitation, this invention relates to transfer finger shift apparatus for use in multi-station transfer presses employing moving die bolsters.

BACKGROUND OF THE INVENTION

Transfer presses are built to accommodate a plurality of forming dies arranged in a sequence to produce a completed stamping for each stroke of the press. Generally, the dies are uniformly spaced in the transfer press so that a transfer feed can be utilized to automatically move the work pieces sequentially from one die to the next as the stamping takes place.

Such transfer presses are usually utilized in the stamping of high production items. Frequently, it is desirable to change the die sets to produce other items. In previously known transfer presses, a substantial amount of time has been required for the die changes.

In earlier presses, for example, it was necessary for workmen to go into the press, remove the dies and the transfer fingers which are utilized for the purpose of transferring the material from one die to the other, and place new dies and transfer fingers therein. During such time, the press was shut down.

Later developments have utilized moving die bolsters so that a press could be operating with one set of dies in a bolster while the other bolster was moved out of the press and the dies and transfer fingers replaced thereon. Such a procedure was considerably better than the original and required less down time for the press.

In automated transfer presses, a set of transfer fingers mounted on transfer rails are utilized to move blank material from the stack to the first die and in some instances to move the finished product from the last die to a conveyor. Since these transfer fingers were located on transfer rails positioned on the fixed bed portions of the press, they were not removed with the moving bolsters. Accordingly, the press had to be shut down to permit workmen to enter the press and change out the transfer fingers in the fixed bed portion of the press, resulting in substantial downtime.

An object of this invention is to provide shifting apparatus that moves the transfer fingers from the rails on the fixed bed portion of the press to the rails on the moving bolster so that all of the transfer fingers related to the new dies can be placed thereon while the bolster is in a location out of the press. Once returned to the press, the shifting apparatus moves the appropriate transfer fingers back onto the rails located on the fixed bed of the press. Such an arrangement places the press quickly and automatically in condition for stamping the new product.

SUMMARY OF THE INVENTION

This invention is directed toward a multi-station transfer press that includes a fixed head, moveable die bolsters, and a die press member moveable toward and away from one of the die bolsters to form work pieces in the dies. The press includes first and second transfer rail sets moveable in horizontal, vertical and transverse directions with the first transfer rail set being located on the bolster and the second transfer rail set being located on the fixed bed. The transfer rail sets are arranged, at times, in alignment in end-to-end relationship. The press also includes means for moving the transfer rail sets. Transfer fingers that are carried by the transfer rail sets engage the work pieces and move the work pieces through the various positions of the transfer press. A transfer finger shift is provided that includes a portion located on the first transfer rail set on the bolster and a portion located on the second transfer rail set on the fixed bed. The transfer finger shift also includes a shift lock mounted on the bolster that is engageable with the transfer fingers located on the fixed bed, so that the transfer fingers located on the fixed bed can be locked to the bolster for movement into and out of the press.

In another aspect, this invention relates to a method for moving transfer fingers normally located on the fixed bed of a transfer press to a moving die bolster. The method comprises the steps of elevating the transfer fingers located on the fixed bed to a height adequate to clear the transfer fingers located on the die bolster; moving the transfer rail sets in a direction to move the transfer fingers on the fixed bed over the bolster; locking the transfer fingers to the bolster; and moving the transfer rail sets toward the fixed bed to move the transfer fingers normally located on the bolster under the locked transfer fingers.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
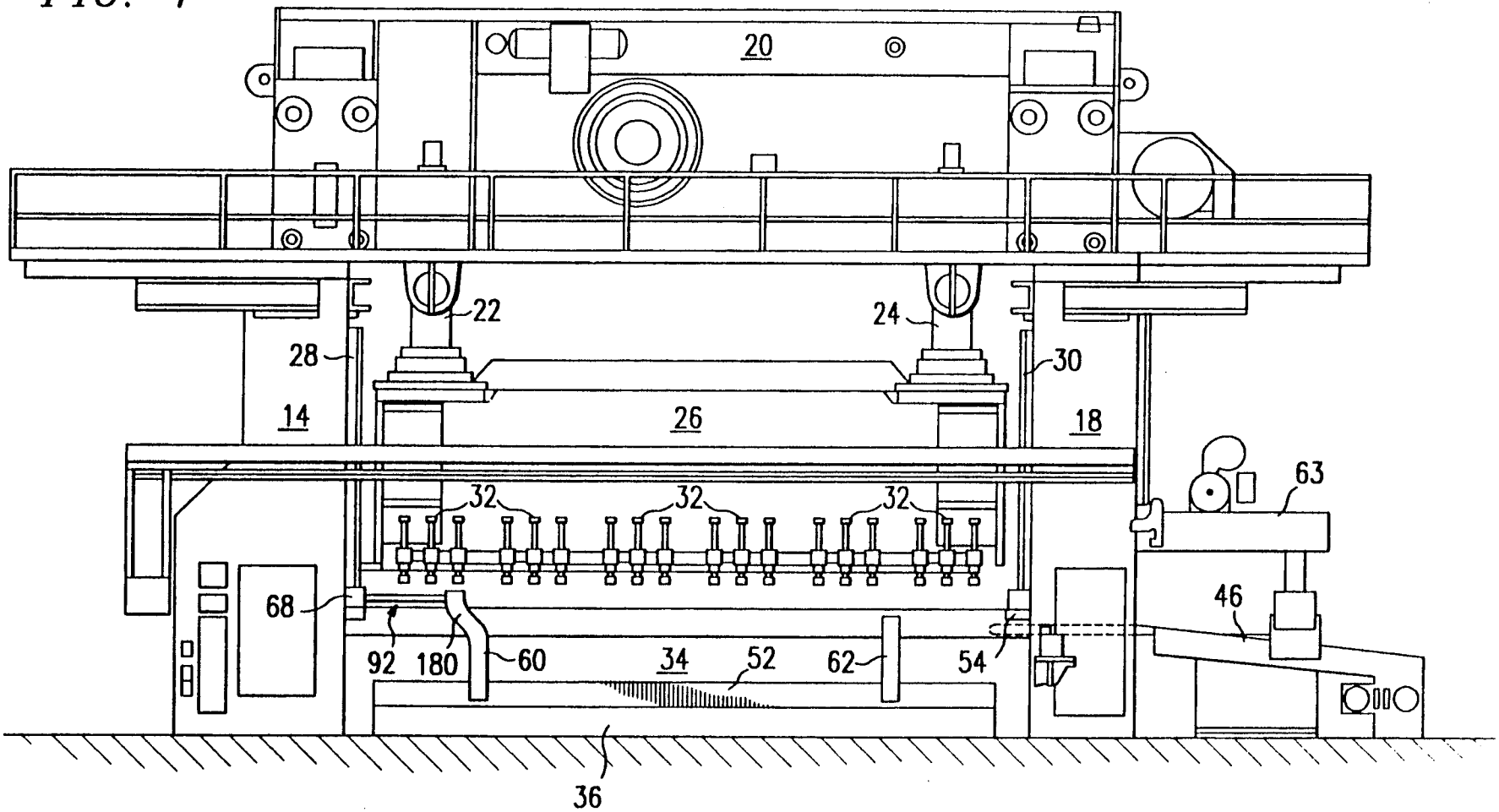
FIG. 1 is a front view of a multi-station transfer press that is constructed in accordance with the invention.
Figure 2:
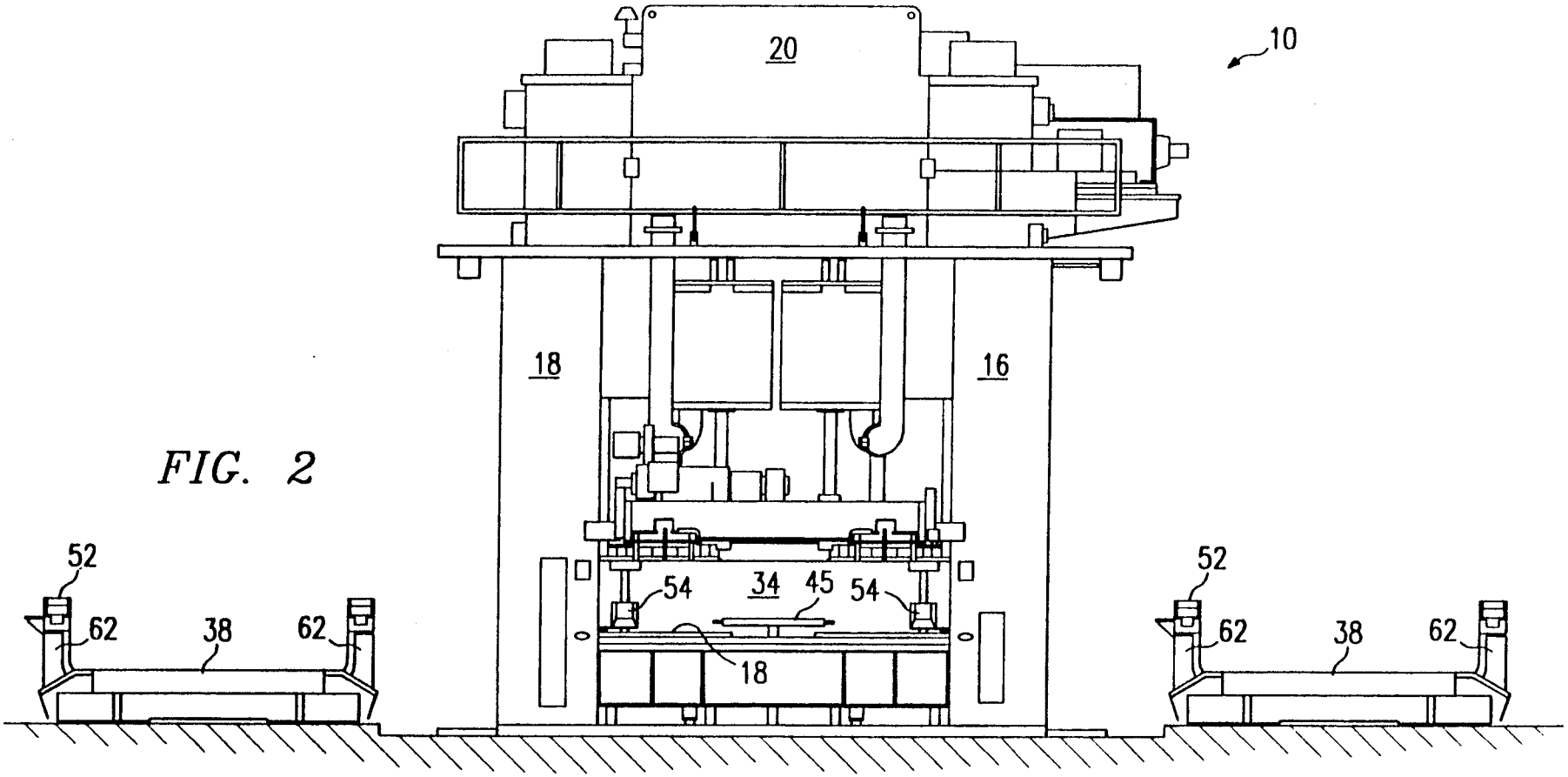
FIG. 2 is an end view of the transfer press of FIG. 1.

Referring to the drawing and to FIGS. 1 through 4 in particular, shown therein and generally designated by the reference character 10 is a transfer press that is constructed in accordance with the invention. Generally, the press 10 includes four vertical columns 12, 14, 16 and 18 which support a press head assembly 20. Carried by the head assembly 20 are link connections 22 and 24 which cause a press slide 26 to move in vertical reciprocating motion as defined by the ways 28 and 30. At its lower end, the slide 26 is provided with a plurality of clamps 32 that connect upper dies (not shown) to the press slide 26. Located below the slide 26 is an opening 34 sized to receive moving bolsters 36 and 38. Appropriate clamps are provided to lock the bolsters in place in the press 10.

Figures 3, 4:
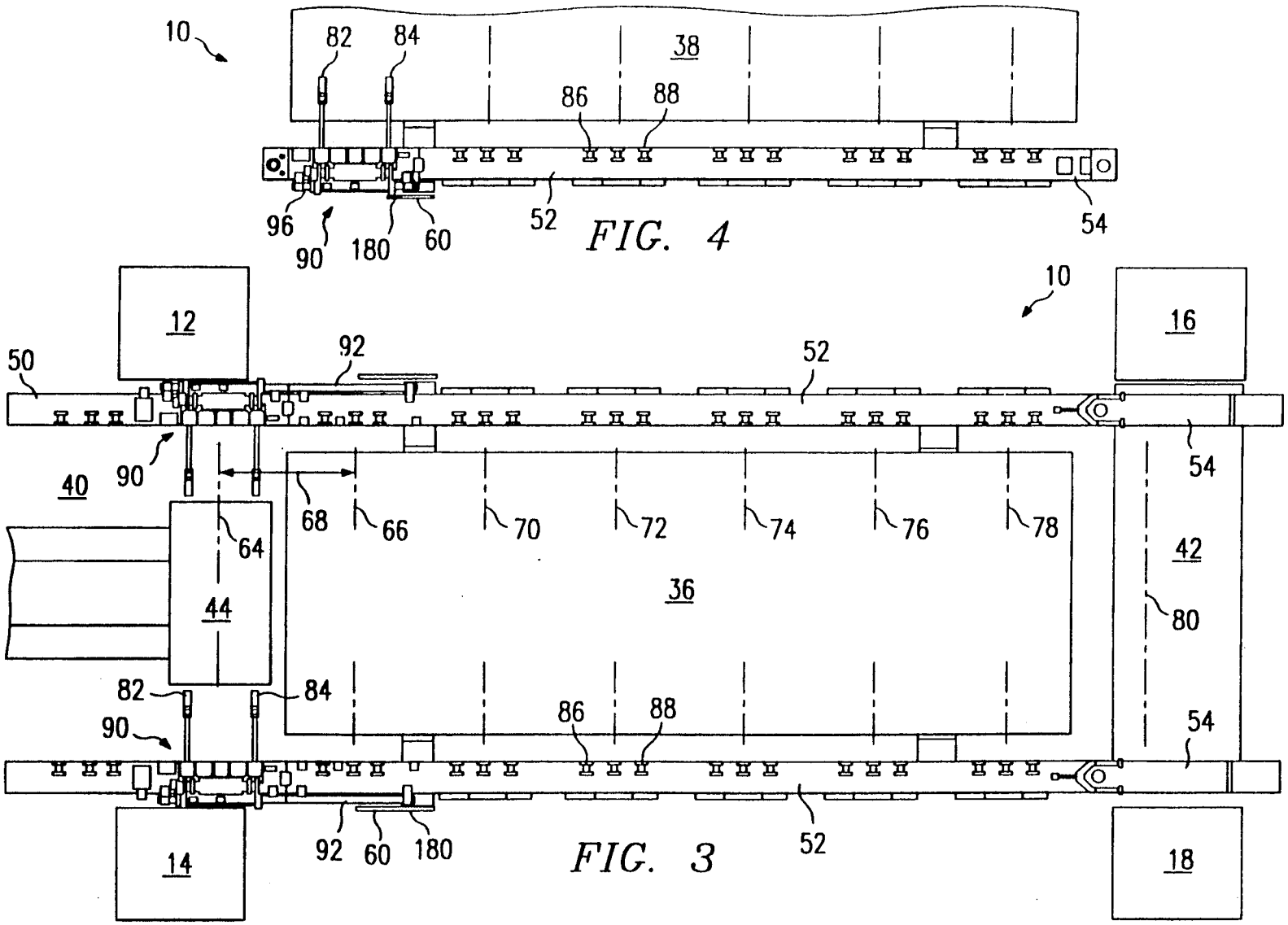
FIG. 3 is a plan view, somewhat schematic, of the press of FIG. 1 where certain portions thereof are removed to more clearly illustrate parts of the apparatus.
FIG. 4 illustrates part of a bolster for the transfer press of FIG. 1 removed from the press and with the transfer fingers moved from the fixed bed of the press to the bolster.

As may be seen more clearly in FIG. 3, the press 10 also includes fixed beds 40 and 42 which also aid in supporting the moving bolsters in the press 10. In the press 10 as illustrated, the material that is to be stamped is moved to a position illustrated by the reference character 44 and moves from left to right through the press 10 and is discharged from the fixed bed 42 such as by use of a conveyor 45 (See FIGS. 1 and 2).

The press 10 also includes transfer rail sets 50 located over the fixed bed 40, transfer rail sets 52 located on the bolsters 36 and 38 and transfer rail sets 54 located over the fixed bed 42. Although somewhat schematic, the joinder of the rail sets 50 and 52 can be more clearly seen in FIGS. 13, 14 and 15. As shown therein, the rail sets 50 and 52 are arranged in an end-to-end relationship with a slight overlap for purposes that will be described more fully hereinafter. As is to be expected, the length of the rail sets 52 is such that they will pass through the opening 34 in the press 10.

Figure 6:
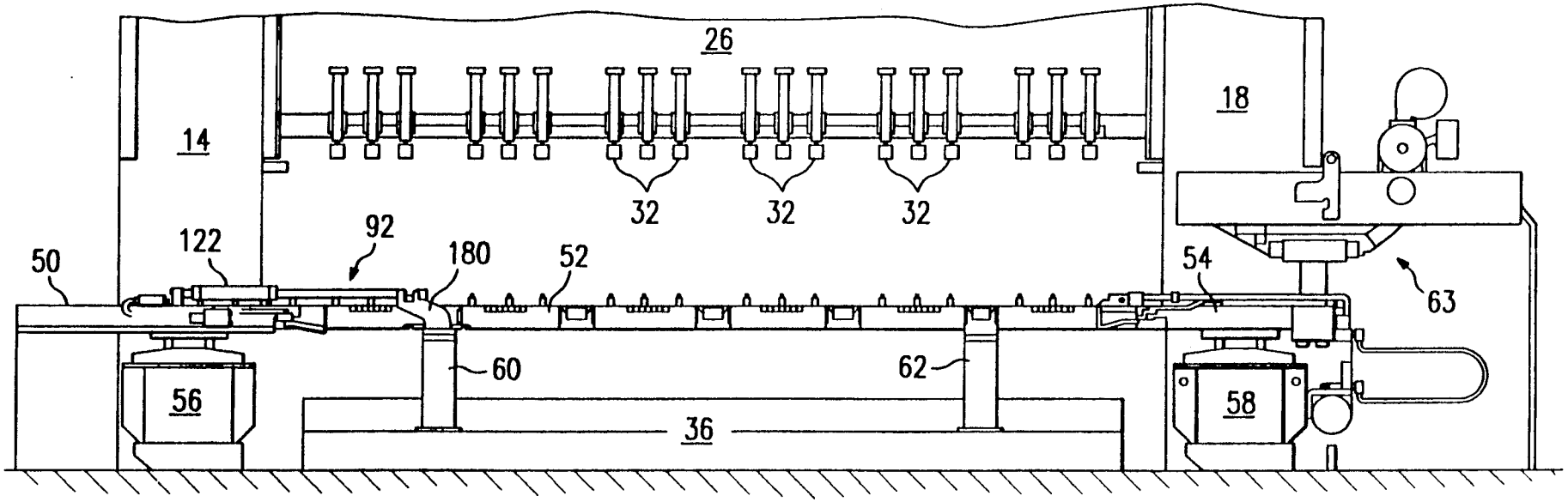
FIG. 6 is a fragmentary front view of the press of FIG. 1 with certain parts removed to illustrate the apparatus more clearly.

The transfer rail set 50 are supported by a rail guide of a lift-clamp module 56. Similarly, the transfer rail set 54 is supported by transfer rail guides of a lift-clamp module 58 as illustrated in FIG. 6. The transfer rail set 52 which extends across the bolster 36 and is moveable therewith is supported by being rigidly clamped to rails 50 and 54. Rail support members 60 and 62, located in the bolsters, are supports onto which rail sets 52 are placed during a die change. The transfer rail sets 50, 52 and 54 are all caused to move back and forth across the press 10 by a drive mechanism 63 (see FIG. 1).

Referring again to FIGS. 3 and 4, it can be seen that the center line of the position 44 which is designated by the reference character 64 is spaced from the center line of the first die station 66 by a distance 68. Subsequent die stations 70, 72, 74, 76, 78 and the part unloading station 80 are all equidistant and each of those distances is equal to the distance 68. Accordingly, movement of the transfer rail sets 50, 52 and 54 toward the right a distance equal to the distance 68 moves the raw material from the position 44 into the center of the first die 66, moves the material that was in the first die 66 to the second die 70 and so forth. In view of this, transfer fingers 82 and 84 can be provided at equidistant spacing along the transfer rail sets and fitted into the clamp holders as exemplified by the holders 86 and 88.

In the press 10 illustrated, there are six die stations. However, it will be understood that as many die stations as desired can be positioned within the space. It is necessary that they be spaced equidistantly so that the transfer rails and dies can be appropriately positioned to provide for the automatic movement of the material through the press 10.

Figure 5:
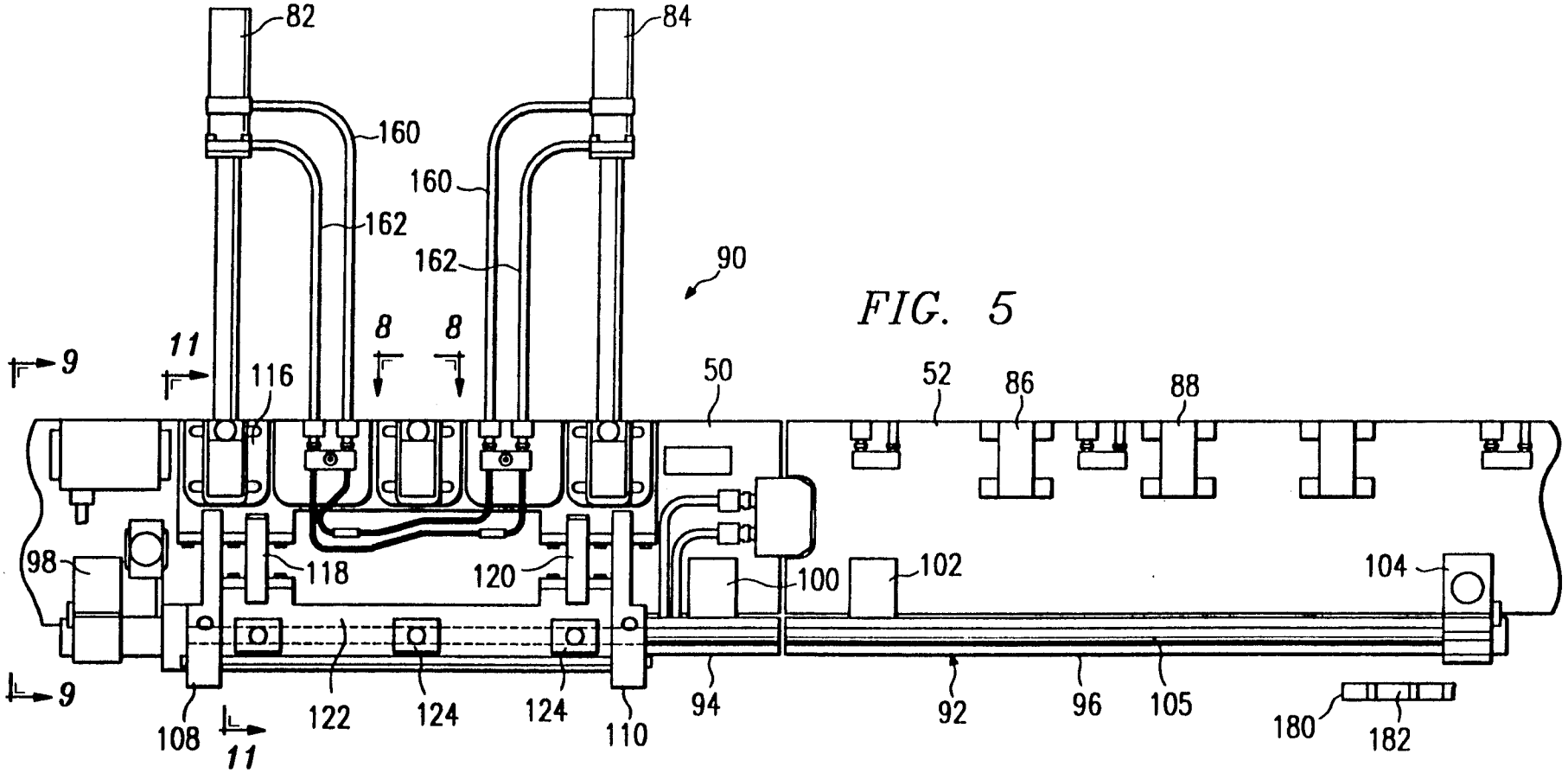
FIG. 5 is an enlarged view of the transfer finger shift apparatus of FIG. 3 which is also constructed in accordance with the invention.

As shown in FIGS. 3 and 4 and in more detail in FIG. 5, the press 10 is provided with a transfer shift apparatus 90 that moves the transfer fingers 82 and 84 from over the fixed bed 40 of the press 10 onto the bolster 36 and secures the transfer fingers thereon so that they can be removed when the bolster 36 is removed, as illustrated by the position of the bolster 38 in FIG. 4.

In FIG. 5 it can be seen that the shifting apparatus 90 includes a shift shaft assembly 92 that is comprised of a shift shaft 94 mounted on the transfer rail set 50 and a shift shaft 96 that is mounted in an end-to-end relationship with the shaft 94 on the transfer rail set 52. It will, of course, be understood that while the shifting apparatus 90 is described in connection with the input or raw material side of the press 10, the output side may also be provided with such apparatus, if desired. The shafts 94 and 96 are supported by mounting brackets 98, 100, 102 and 104 so that each of the shafts 94 and 96 is independently supported because they are not joined and move independently at times.

The shaft assembly 92 is provided with a longitudinally extending slot 105 which extends from one end of the shaft assembly 92 through the opposite end. As may be seen more clearly in FIGS. 9 and 10, arcuate slots 106 intersect the slot 105 adjacent to the location of the two transfer finger pivot arms 108 and 110.

Carried by the pivot arms 108 and 110 are detents or rollers 112 which ride in the slots 105 and 106. The relationship between the slots 105, 106 and the detents 112 is such that the arms 108 and 110 are permitted to pivot, when the detents 112 are located in the arcuate slots, from the position illustrated in FIG. 9 to the position illustrated in FIG. 10. Upon reaching the position of FIG. 10, the pivot arms can be moved longitudinally in the slot 105 but can no longer pivot since the detents have left the arcuate slots 106.

The opposite end of the pivot arm is slidingly and pivotally connected by trunnion 114 to a transfer finger holder 116. It will be understood, of course, although not shown, that the pivot arm 110 is similarly connected to the same transfer finger holder 116.

Figure 12:
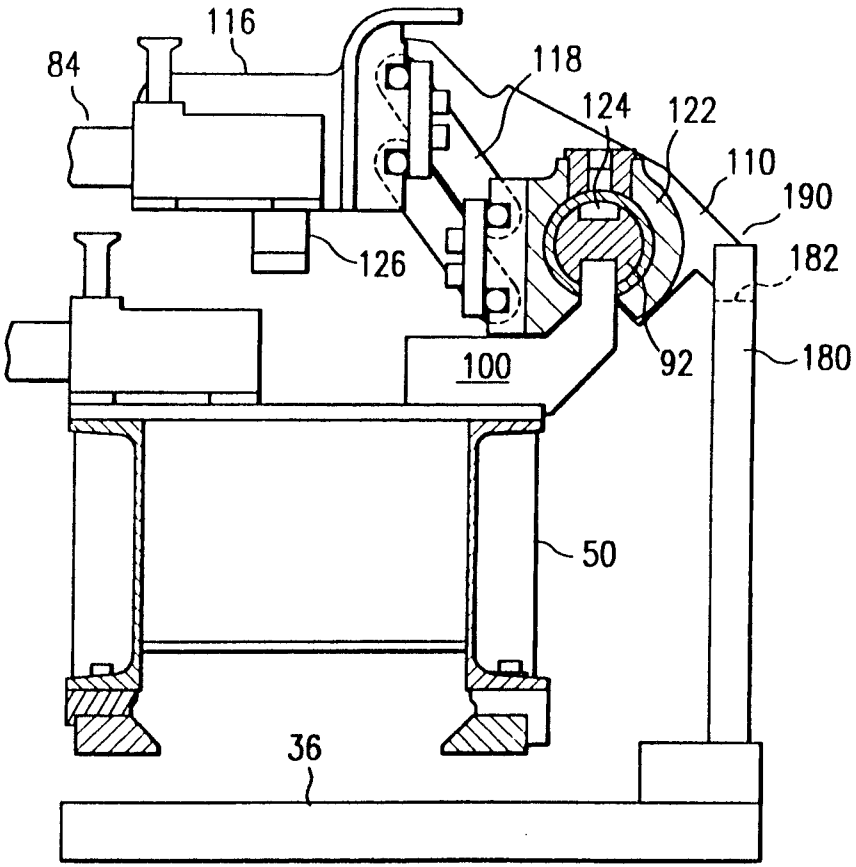
FIGS. 11 and 12 are enlarged fragmentary views that also illustrate the apparatus and operation of a portion of the transfer finger shift apparatus taken generally along the line 11—11 of FIG. 5.
Figure 11:
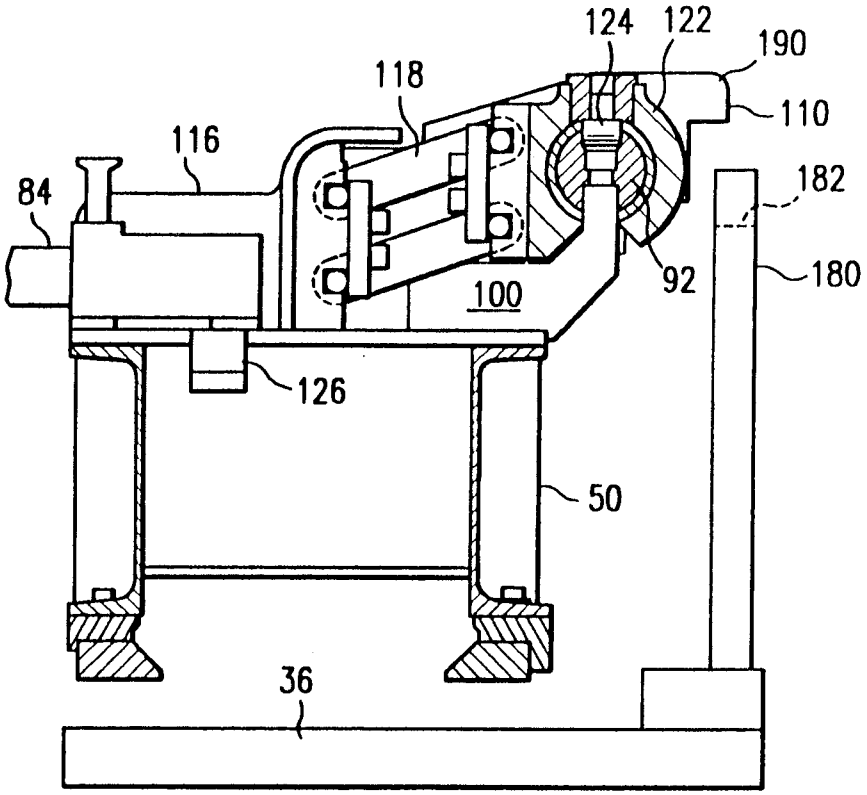

To maintain the horizontal orientation of the transfer finger holder 116, spaced, four-bar linkages designated by the reference characters 118 (see FIGS. 11 and 12) and 120 (see FIG. 5) extend from the transfer finger holder 116 to a shift base member 122. The arrangement is such that ends of the linkages are pivotally connected with either the transfer finger holder 116 or with the shift base member 122.

As may be appreciated from viewing FIG. 5, shift base member 122 encircles the shaft assembly 92 and is provided with three spaced rollers or detents 124 that are disposed in the slot 105. This arrangement provides for the longitudinal movement of the shift base member 122 and prevents pivotal movement of the shift base member 122 relative to the shaft assembly 92.

Figure 8:
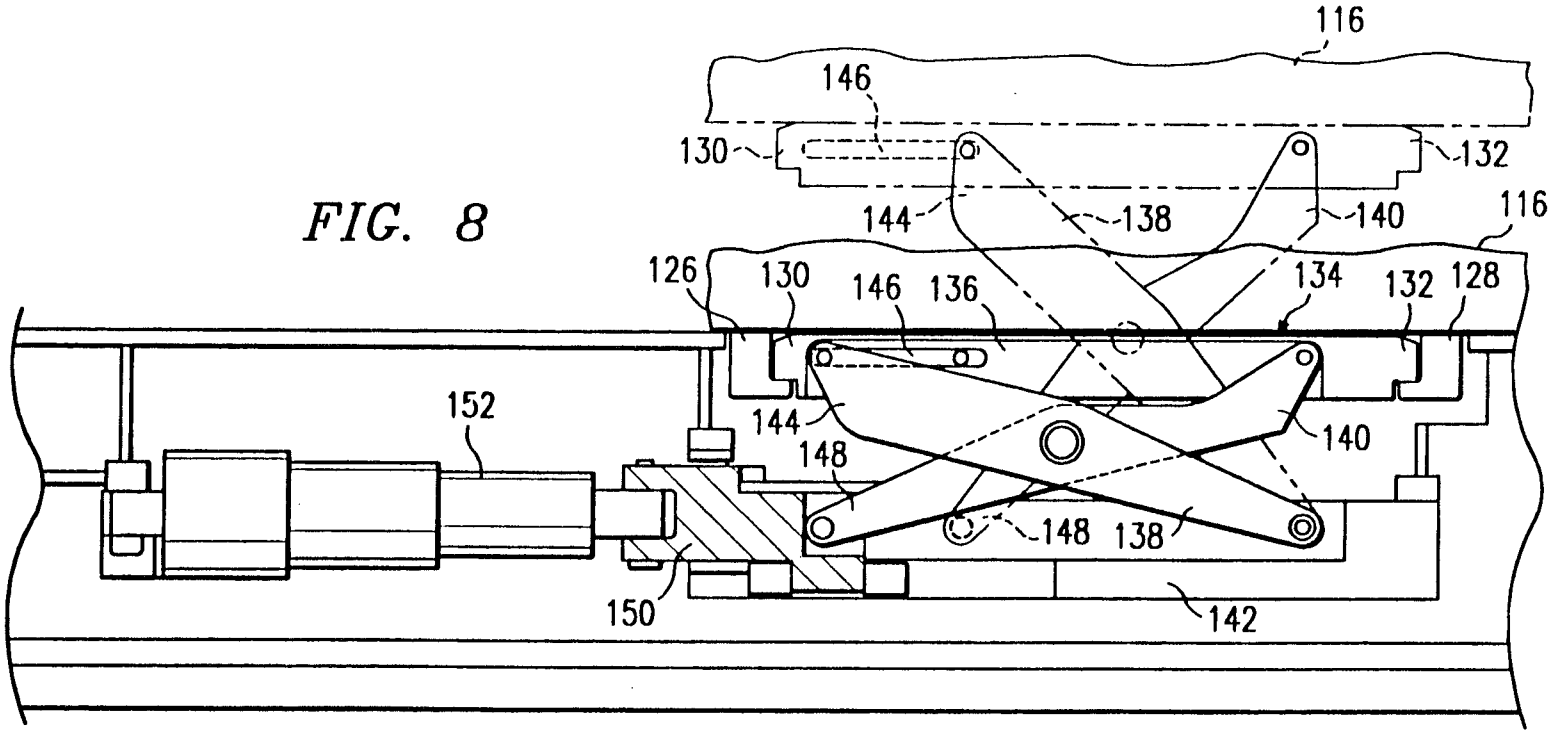
FIG. 8 is an enlarged fragmentary view illustrating an elevating mechanism utilized in the press of FIG. 1 taken generally along the line 8—8 of FIG. 5.
Figure 10:
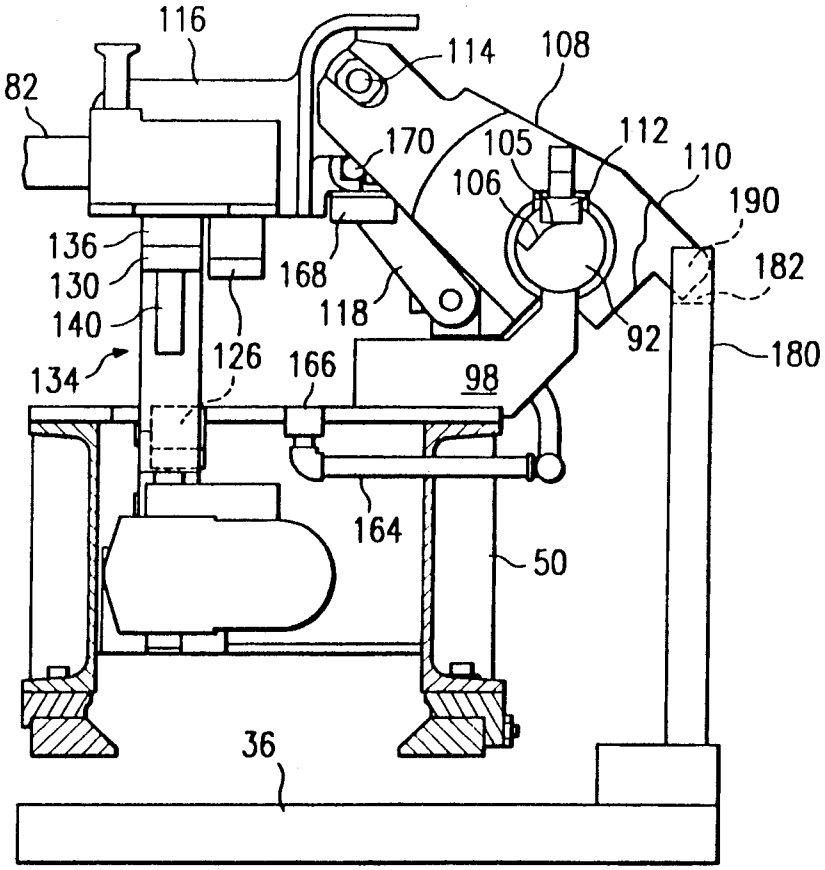
FIGS. 9 and 10 are enlarged fragmentary views illustrating the structure and operation of a portion of the transfer finger shift apparatus taken generally along the line 9—9 of FIG. 5.
Figure 9:
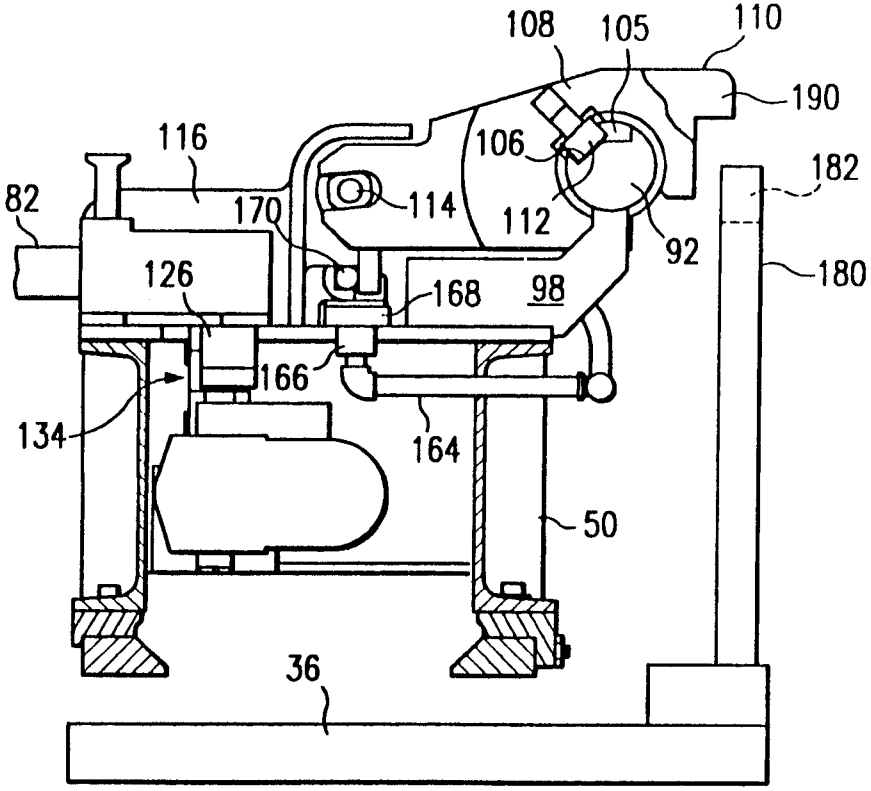

As can be seen by comparing FIGS. 9 and 10, upward movement of the transfer finger holder 116 causes pivoting of the pivot arms 108 and 110 and of the linkages 118 and 120. Movement of the transfer finger holder 116 is also arcuate and relatively toward the shaft 92 at the same time that it is rising. The transfer finger holder 116 maintains its level orientation because of the four-bar linkages 118 and 120. The desirability of having such a movement pattern is that the lower end of the transfer finger holder 116 is provided with latch members 126 and 128 (see FIG. 8) that function in conjunction with latch abutments 130 and 132 that are located on an elevating mechanism 134.

The enlarged fragmentary view of FIG. 8 illustrates the structure of the elevating mechanism 134 in detail. As shown therein, the elevating mechanism 134 includes an elevation member 136 upon which the abutments 130 and 132 are located. Pivotally connected to the elevation member 136 is a pair of scissor members 138 and 140 which are pivotally connected near their center and also pivotally connected to the elevation member 136 and to the fixed bed portion 142 of the press 10. It will be noted that at end 144 a scissor member 138 is also slidingly connected with the elevation member 136 by virtue of a slot 146 located therein.

To cause the elevation member 136 to move from the lower locked position illustrated in solid lines to the elevated position illustrated in dotted lines, an end 148 of the scissor member 140 is pivotally connected to a slide 150 which is in turn connected to a telescoping cylinder 152. The arrangement is such that extension of the telescoping cylinder 152 toward the right as seen in FIG. 8 causes the slide 150 to move in that direction, moving the end 148 of the scissor member 140 to the position illustrated in dotted lines. When this occurs, the member 138 is also moved to the dotted line position elevating the elevation member 136 to the position shown in dotted lines. Collapsing the cylinder 152 results in the leftward movement of the end 148 of the scissor member 140 returning the elevation member 136 to the solid line position. The linear motion for the elevation function can be provided by a motor driven ball and screw if desired.

In FIGS. 9 and 10, an end view of the elevating mechanism 134 is illustrated, showing the elevating mechanism 134 with the elevation member 136 in engagement with the bottom of the transfer finger holder 116. The holder 116 has been moved from a lower locked position as illustrated in FIG. 9 to the elevated position shown in FIG. 10.

Although not shown in detail, the transfer finger members 82 and 84 are provided with pneumatically actuated clamps to grip the work piece as is well known in the art. Conduits 160 and 162 are connected to provide high pressure air supply to the transfer finger members (see FIG. 5). It will be understood that the similar transfer finger members located on the rail set 52 which moves with the bolster are similarly constructed. Accordingly, it is necessary to provide for the automatic making and breaking of connectors so that air can be supplied to all of the transfer fingers. In addition, the transfer fingers 82 and 84 shown on the fixed rail set 50 are elevated at times as discussed in connection with FIGS. 9 and 10 and, consequently, some means must be provided for making and breaking a connector to provide air into the conduits 160 and 162.

In FIGS. 9 and 10, there is shown a pneumatic line 164 connected to one-half 166 of a connector mounted on the rail set 50. The other half 168 of the connector is carried by the transfer finger holder 116. A conduit 170 connected thereto is arranged to provide air supply to the conduits 160 and 162 as appropriate. Multiple conduits and connectors can be provided as needed to provide the desired power to the transfer fingers and to provide for sensors (not shown) as needed. In FIG. 10, the connector halves 166 and 168 are illustrated apart, thus placing the connector in the broken condition. Similarly, multiple electrical conductor cables (not shown) can be automatically connected by means of multiple pin male plug and female receipt for sensor devices installed on transfer fingers to indicate that part has been picked up by transfer fingers.

As described previously, the transfer rail sets 50, 52 and 54 are separate although they are aligned in an end-to-end relationship. When it is desired to remove a bolster from the press 10, it is necessary to separate the rail sets so that the rail sets 52 can be removed with the bolster. Accordingly, it is also necessary to provide a means for breaking any connectors (pneumatic, electric, or hydraulic) that extend from the rail sets 50 and 54 which are disposed over the fixed portions of the press 10 from the rail set 52 which is located on the bolsters.

Figure 7:
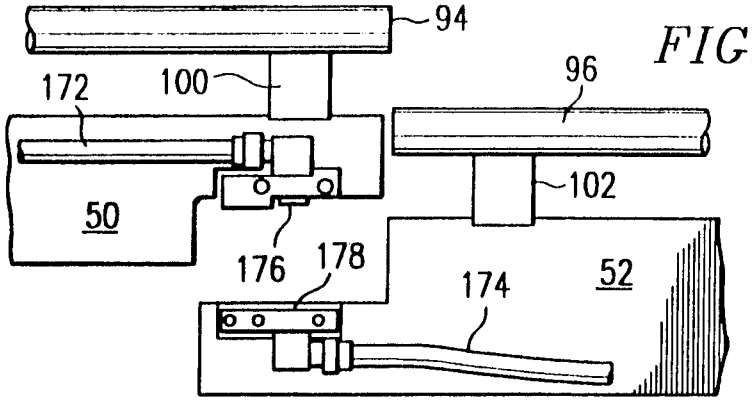
FIG. 7 is an enlarged fragmentary view illustrating the interconnection between transfer rails and a shift shaft utilized in the press of FIG. 1.
Figure 13:
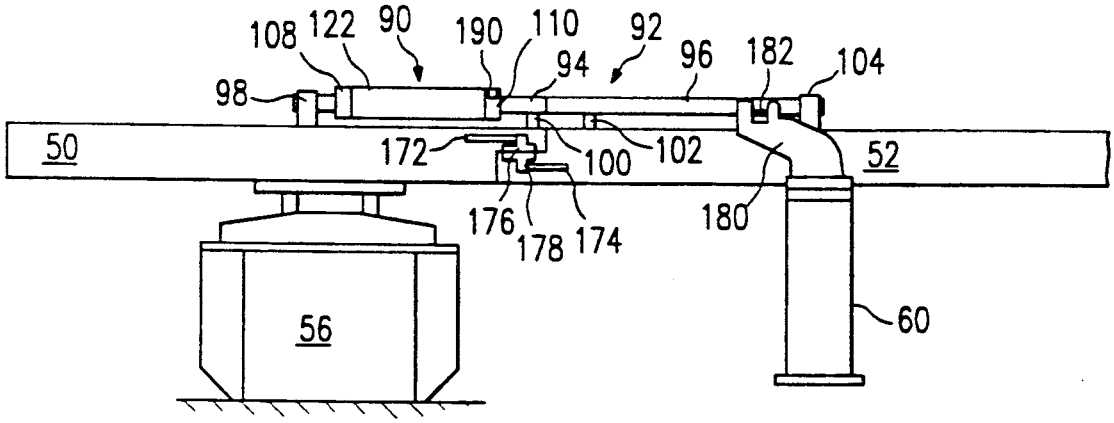
FIGS. 13, 14 and 15 are sequential operational diagrams illustrating the operation of the transfer finger shift apparatus and movement of the transfer rails to release the bolster for movement into and out of the die press.
Figure 14:
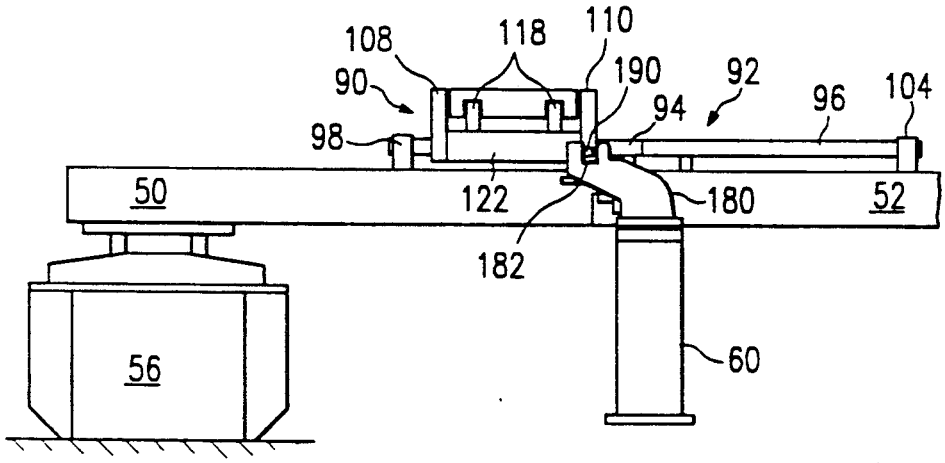
Figure 15:
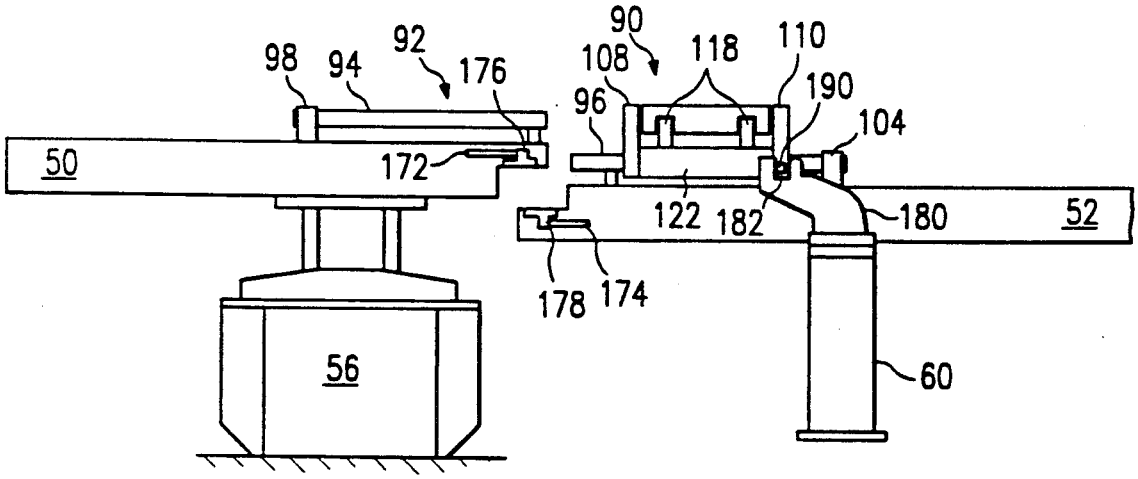

As shown in FIG. 7 and in FIGS. 13, 14 and 15, the conduit 172 located on the rail set 50 is connected to a conduit 174 located on the rail set 52 by means of connector halves 176 and 178. In FIG. 15, the rail sets 50 and 52 have been separated and the connector halves 172 and 178 are shown in the broken condition. The makeable and breakable connectors have been described herein in connection with conduits which presumably would be used with pneumatic or hydraulic circuitry. However, it should be understood that in the event that electrical power is to be utilized on the rail sets or on the transfer finger members, electrical connectors could be provided in lieu of the connectors described.

Mounted on the rail support 60 is a carriage shift lock member 180. The lock member 180 can be seen in FIGS. 1, 6 and perhaps more clearly in schematic FIGS. 13 through 15. Near its upper end, the lock member 180 is provided with a notch 182 for receiving a lock dog 190 which forms part of the transfer finger pivot arm 110.

OPERATION

The press 10 in the starting condition has upper dies (not shown) located in the slide 26 and held securely therein by the clamps 32. The bolster 36 is located in the space 34 with lower dies (not shown) mounted thereon and appropriate transfer fingers attached. The press 10 is actuated, moving the slide 26 downwardly and pressing the dies together to form the metal blanks located therebetween. Upon completion of the downward stroke, the slide 26 is raised and the rail sets moved to the right, shifting the transfer fingers and attached parts from one die station to the next and from the fixed portion of the bed onto the first die. This operation is continued until all the parts desired have been manufactured.

When the dies are to be removed, slide 26 is lowered onto the bolster, the clamps 32 released, and the slide 26 raised. This leaves the upper dies on the lower dies and on the bolster. The rail sets 50, 52 and 54 are then shifted to the right as shown in FIG. 14. This movement displaces the holder 116, the base 122, and the pivot arms 108 and 110 to the right. At the end of this travel, the pivot arm 110 is located adjacent the notch 182 located in the shift lock 180.

Actuation of the telescoping cylinder 152 (FIG. 8) causes the scissor members 138 and 140 to elevate the elevation member 136 to the dotted line position shown therein. When in this position, it can be seen in FIG. 10 that the transfer finger holder 116 has been elevated with the latches 126 and 128 thereon disengaged from the latch abutments 130 and 132 on the elevation member 136. The connector halves 166 and 168 are separated by the movement, breaking the conduit 164. At the same time, pivot arm 110 has been pivoted through the arcuate slot 106 until the detent 112 is disposed in the slot 105. With this motion, the lock dog 190 thereon moves into the slot 182.

Upon completion of the locking action, rail sets 50, 52 and 54 are shifted to the left to their original position. It will be noted that the transfer fingers 82 and 84 are disposed above the transfer fingers located on the transfer rail set 52 as shown in FIG. 4. It will also be noted that the transfer finger holder 116 cannot pivot about the shaft 92 due to the location of the detent 112 in the longitudinal slot 105. Accordingly, the transfer fingers 82 and 84 and finger holder 116 are retained over the bolster 36 as the rail sets 50, 52 and 54 are withdrawn to the position shown in FIG. 15.

Upon reaching the end of the return travel, the transfer rail guides of lift/clamp modules 56 and 58 are actuated, raising the rail sets 50 and 54 slightly above and away from the rail set 52 to approximately the position shown in FIG. 15. When in this condition, the connector halves 176 and 178 separate, breaking the connection between the conduits 172 and 174. Upon release of the bolster braking mechanism (not shown) the bolster is removed from the space 34 below the press 10.

Previously, the bolster 38 has been disposed to one side of the press 10 and has been provided with appropriate transfer fingers, lower dies and upper dies to be used for the next run in the press 10. As the bolster 36 is withdrawn from one side of the press 10, the bolster 38 is inserted in the space 34 and locked therein.

When locked, the transfer rail guides of lift/clamp modules 56 and 58 are again actuated, moving the transfer rail sets 50 and 54 downwardly and toward rail set 52 into engagement with the transfer rail set 52 located on the bolster 38. Simultaneously, the connector halves 176 and 178 the shafts 94 and 96 are moved into alignment. The elevation member 134 is raised by actuation of the cylinder 152. Rail sets 50, 52 and 54 and shafts 94 and 96 are shifted to the right until the elevation member 136 is disposed beneath and in engagement with the transfer finger holder 116. With the shafts 94 and 96 shifted to the right as shown in FIG. 14, the arcuate slots 106 are located in proper positions to receive the detents on the pivot arms 108 and 110.

The elevation member 136 is lowered and the holder 116 returns to its lower position, engaging the latch members 126 and 128 with the latch abutments 130 and 132 securely retaining the transfer finger holder 116 and transfer fingers 82 and 84 on the rail set 50. The rail set 50, by virtue of the movement of all the rail sets to the right, is disposed below the holder 116. The holder 116 and elevating apparatus 134 are securely connected and returned to the left and into position over the fixed bed 42 of the press 10 adjacent the raw material or stock position 44.

The press slide 26 is lowered onto the upper dies (not shown) which are again clamped by means of the clamps 32. The slide 26 and upper dies are then raised off the lower dies and the press 10 is in condition for beginning the operation with the new dies.

It will, of course, be understood that the entire operation is automatic. The necessary conduits and electrical connections are made and broken automatically during the changing of the bolsters. The transfer fingers located over the fixed portion of the press on either or both ends thereof are easily and automatically removed without the necessity of personnel entering the press and the extreme downtime associated with manually changing the fingers. In view of this, all of the apparatus associated with the dies has been moved from the press and is available outside of the press for the replacement of all dies and all transfer fingers associated therewith for the next set of dies.

Having described but a single embodiment of the invention, it will be apparent that many changes and modifications can be made thereto without departing from the spirit or scope of the invention.

What is claimed is:

1. A method of changing transfer fingers in a transfer press having a fixed bed, at least one moving die bolster moveable into and out of the transfer press, a first transfer rail set located on the fixed bed for carrying first transfer fingers and a second transfer rail set located on the moving die bolster for carrying second transfer fingers, the first and second transfer rail sets aligned in an end to end relationship when engaged, the method comprising the steps of:

moving the first and second transfer rail sets toward the moving die bolster to position the first transfer fingers over the moving die bolster;

elevating the first transfer fingers to a height adequate to clear the second transfer fingers;

locking the first transfer fingers to the bolster;

moving the first and second transfer rail sets toward the fixed bed to position the first transfer fingers on the second transfer rail set with the first transfer fingers locked to the moving bolster and to move the second transfer fingers under the first transfer fingers;

moving the first transfer rail set out of engagement with the second transfer rail set;

moving the bolster with the first and second transfer fingers out of the transfer press;

replacing the first and second transfer fingers on the bolster with new first and second transfer fingers, respectively;

moving the bolster with the new first and second transfer fingers into the transfer press;

engaging the first transfer rail set with the second transfer rail set;

moving the first and second transfer rail sets toward the bolster to move the new second transfer fingers located under the new first transfer fingers away from the new first transfer fingers;

unlocking the new first transfer fingers from the bolster;

lowering the new first transfer fingers;

moving the transfer rail sets toward the fixed bed to move the new first transfer fingers to a position over the fixed bed; and latching the new first transfer fingers to the fixed bed.

2. A method of moving first transfer fingers from a fixed bed in a transfer press to a moving die bolster moveable into and out of the transfer press, the transfer press including a first transfer rail set located on the fixed bed for carrying the first transfer fingers and a second transfer rail set located on the moving die bolster for carrying second transfer fingers, the first and second transfer rail sets aligned in an end to end relationship when engaged, the method comprising the steps of:

moving the first and second transfer rail sets toward the moving die bolster to position the first transfer fingers over the moving die bolster;

elevating the first transfer fingers to a height adequate to clear the second transfer fingers;

locking the first transfer fingers to the moving die bolster by engaging the first transfer fingers with means separate from the first and second transfer rail sets; and moving the first and second transfer rail sets toward the fixed bed to position the first transfer fingers on the second transfer rail set with the first transfer fingers located to the moving die bolster and to move the second transfer fingers under the first transfer fingers.

* * * * *

UNITED STATES PATENT AND TRADEMARK OFFICE

CERTIFICATE OF CORRECTION

PATENT NO. : 5,121,623

DATED : June 16, 1992

INVENTOR(S) : Edward J. Brzezniak

It is certified that error appears in the above-identified patent and that said Letters Patent is hereby corrected as shown below:

Column 10, line 10, delete "located" and insert --locked-- therefor.

Signed and Sealed this

Seventh Day of September, 1993

Bruce Lehman

*Attest:*

BRUCE LEHMAN

*Attesting Officer*

*Commissioner of Patents and Trademarks*